United States Patent [19]

Clark

[11] 3,941,382

[45] Mar. 2, 1976

[54] BASKETBALL GAME

[76] Inventor: Robert T. Clark, 5140 Stonehedge Blvd., Fort Wayne, Ind. 46815

[22] Filed: Aug. 9, 1973

[21] Appl. No.: 386,951

[52] U.S. Cl. ..... 273/95 R; 46/31; 273/1.5 A

[51] Int. Cl.[2] ..... A63B 71/02

[58] Field of Search ..... 273/1 A, 1.5, 85 R, 95 R, 273/95 H, 130 G; 35/29 R, 29 C, 8 R; 46/31

[56] References Cited

UNITED STATES PATENTS

| | | | |
|---|---|---|---|
| 1,623,641 | 4/1927 | Sixta | 46/31 |
| 2,076,956 | 4/1937 | Lowenstein | 46/31 X |
| 2,158,475 | 5/1939 | Montine | 35/29 C |
| 2,412,759 | 12/1946 | Sullivan | 35/8 R |
| 2,454,307 | 11/1948 | Cooley | 46/30 X |
| 2,458,984 | 1/1949 | Engle | 35/29 R |
| 2,567,189 | 9/1951 | Davis | 273/130 G |
| 2,891,793 | 6/1959 | Mudry | 272/57 R X |
| 3,137,503 | 6/1964 | Ballard | 273/1.5 R |
| 3,515,385 | 6/1970 | Gunderson | 273/1 A |
| 3,700,240 | 10/1972 | Emeterio | 273/95 R |
| 3,703,291 | 9/1971 | Lutz | 283/85 R |
| 3,709,495 | 1/1973 | Krombein | 273/101 |

*Primary Examiner*—Anton O. Oechsle
*Assistant Examiner*—Harry G. Strappello
*Attorney, Agent, or Firm*—John A. Young

[57] ABSTRACT

A plurality of marking elements of various shape, color and numerical value are connected together, in a row, by flexible straps. The marking elements are laid on a playing area and are flexible to remain substantially flat against the playing surface area. A basket, made from the particular area of a marking element, gives a score according to the number on the marking element and this is a measure of the difficulty in making a basket from that point. Competitive team scoring can be made by recording the occurrence of baskets and numerical value assigned each basket according to the player's location.

1 Claim, 6 Drawing Figures

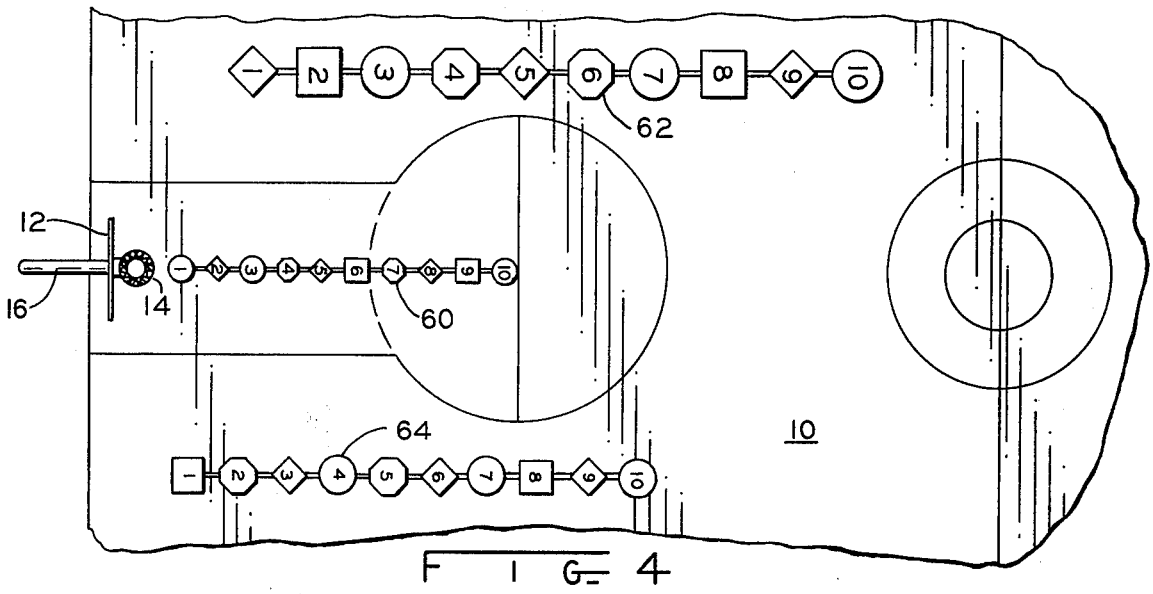
FIG. 4
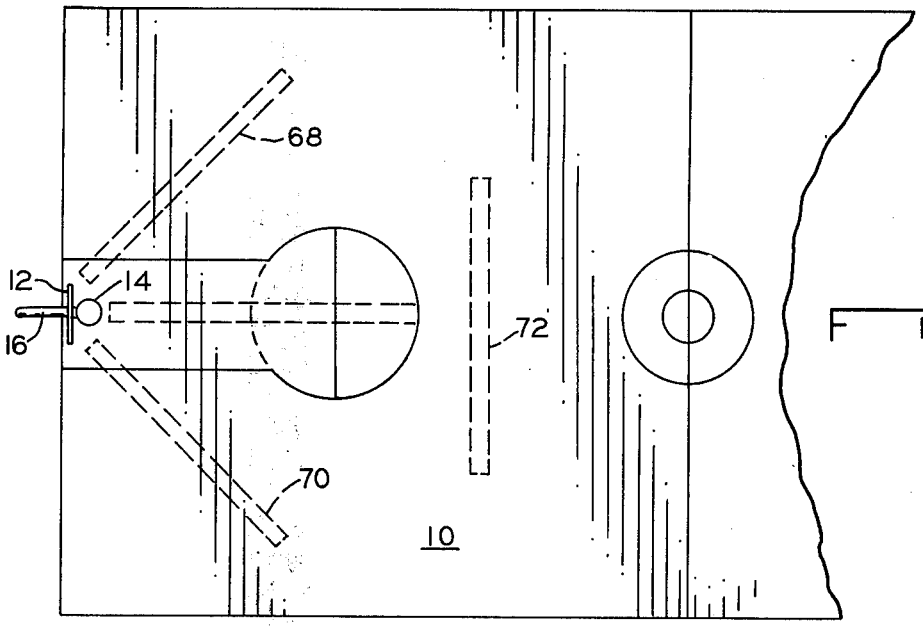
FIG. 5
| NAME | SPOT BALL FRAME 1 | 2 | 3 | 4 | 5 | 6 | 7 | 8 | 9 | 10 | TOTAL SCORE |
|---|---|---|---|---|---|---|---|---|---|---|---|
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
66
FIG. 6

BASKETBALL GAME

BACKGROUND OF THE INVENTION

Basketball as a sport has become too specialized and too much associated with a dwindling number of players. What is needed is a basketball game which will open up competitive sport to people of all skills.

By increasing the scope of available players, it will be possible to open the game of basketball up to mixed groups including those varying in skill, age and sex and make possible competitive as well as individual play for all classes of players.

That is the purpose of the present invention to devise a game which makes it possible for a greater number of people to become involved in basketball so that all may enjoy the game according to a different set of rules while still maintaining the basic principles of basketball.

OBJECTS OF THE INVENTION

It is a principal object of the present invention to devise a variation of the game of basketball to make it possible for a greater number of persons to play for recreation and competition.

It is another object of the present invention to devise a variation of the game of basketball which will sharpen the skills of the player and develop basketball playing skills which will encourage players to improve their game and the resulting skills will carry over into the conventional basketball game.

It is another object of the present invention to provide an inexpensive and readily usable game plan and accompanying equipment which will make it possible to play a variation of the game of basketball and to do so on various playing areas including those found on hardwood floors, pavement, asphalt, etc. so that the game can be employed with or without the use of an expensive playing area.

It is an overall object of the present invention to devise a variation of the game of basketball which will sharpen skills used in conventional basketball but which is so devised as to enlarge the number of available people who can play the sport.

Other objects and features of the present invention will become apparent from a consideration of the following description which proceeds with reference to the accompanying drawings wherein a selected example embodiment of the invention is illustrated by way of example and not of limitation.

DRAWINGS

FIG. 4 is a plan view of a playing area having several of the marking elements at spaced locations on the playing area;

FIG. 5 is a plan view similar to FIG. 4 but showing further emplacements and uses of the present invention; and, FIG. 6 illustrates the scoring card which is used for recording the game which can be played with the present invention.

DETAILED DESCRIPTION OF THE INVENTION

Figure 1:
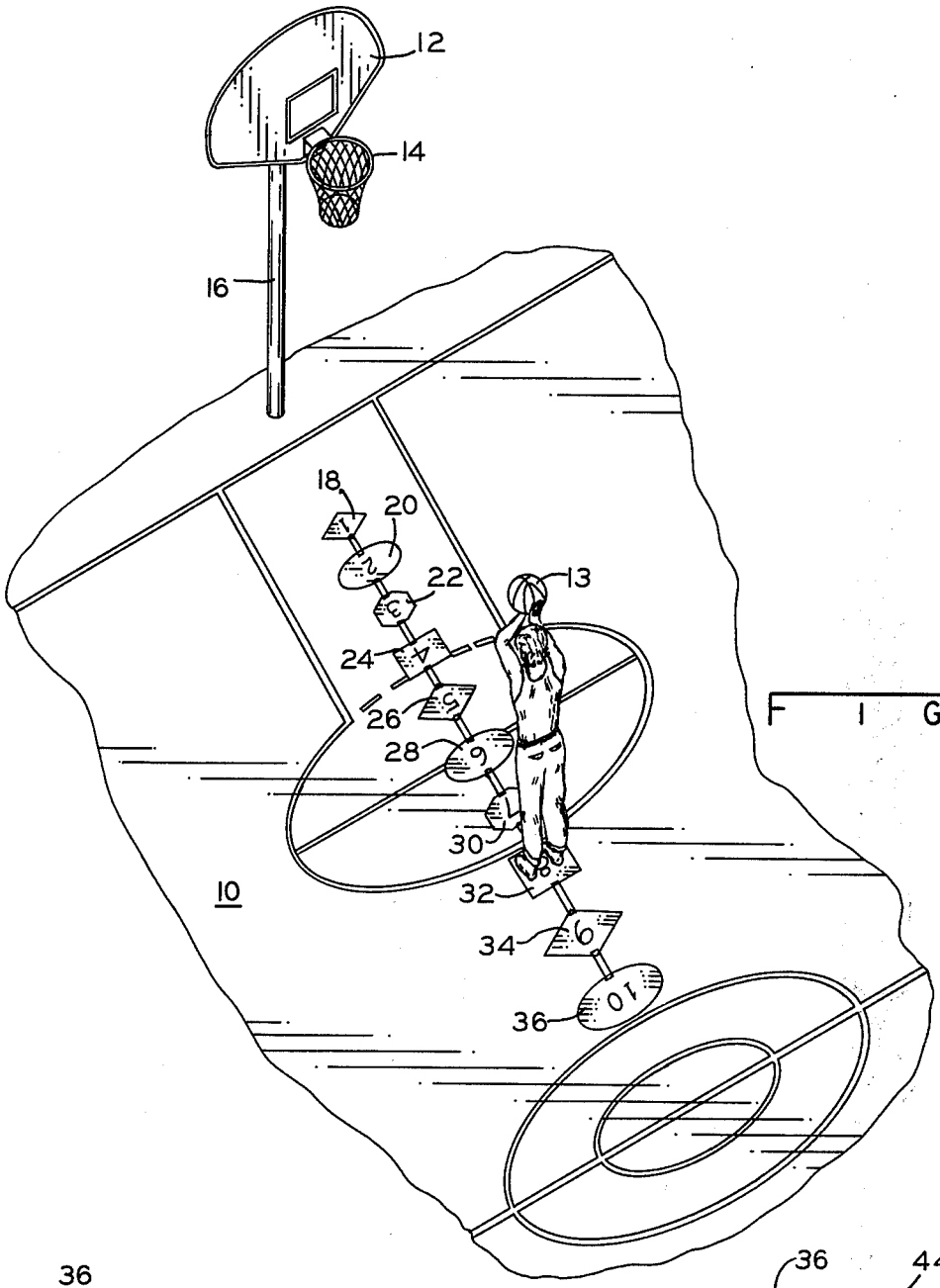
FIG. 1 is an isometric view of playing area including a basket, a player with basketball, and the present invention.
Figure 2:
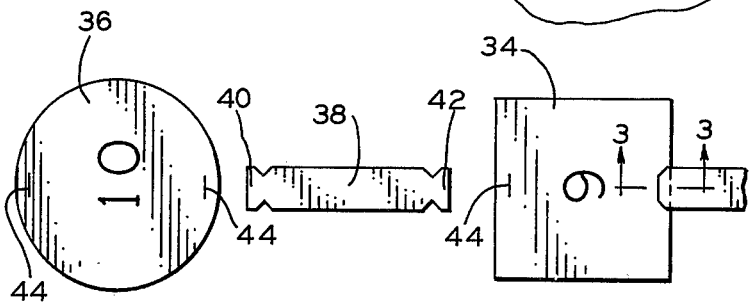
FIG. 2 is an enlarged exploded view of a portion of the invention illustrating the marking elements.

Referring to FIG. 1, a playing area designated generally by reference numeral 10 may consist of a hardwood floor when the game is played in a gymnasium, it being understood that the present invention is usable at any location including driveways for home use basketball courts or any other location that the player may choose to employ this game which is a modified form of basketball.

The basic idea of the basketball game is retained. That is, to pitch the basketball 13 through the basket 14 either with or without the use of the backboard 12. The basket 14 in the particular noted illustration is suspended at the designated height by a pole 16. The present invention improves the marksmanship of a player by providing a series of markers 18–36 which are located on the floor 10 and, by their location determine the degree of difficulty of making a basket by shooting at the designated spot. For example, it is relatively easy to make a basket from the position of marker 18 and therefore a successful basket will be counted the assigned value of the marker, in this particular instance the value 1. Correspondingly, a basket made from marker 20 will have a value of 2 and so on until a basket is made from marker 36 which would carry a value 10, since it is farther from the basket 14 making it relatively more difficult to make a successful shot.

Figure 3:
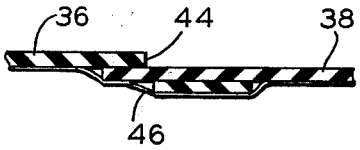
FIG. 3 is a section view taken on line 3—3 of FIG. 2.

The various markers are held together by means of straps 38 having notched ends 40, 42 which are passed through slits 44 and the strap ends are held in place by a tape 46 (FIG. 3) having adhesive thereon. Each indicator 18–36 may vary in shape, size or color and includes a number either embossed, painted or otherwise affixed to the upper surface.

It should be noted that each indicator is relatively flexible and conforms to the playing surface. When it is desired to use the game, the player simply rolls out the indicator to the desired location and commences taking shots from this location.

As indicated in FIGS. 4 and 5, the scoring device can be located either in line with the basket as indicated by the scoring elements 60 or they can be located to the right of the basket as indicated by reference numeral 62 or the left shown by reference numeral 64. In any event, the player or players attempt to make baskets with at least one foot on an individual marker and if successful a score is tallied on score sheet 66 (FIG. 6) and the score assigned corresponds to the value on the individual marker.

The player can sharpen his shooting skills from any part of the court by moving the marker to the right or the left or to be at an angle to the basket as shown by reference numerals 68, 70 (FIG. 5) or transversely to the basket as indicated by reference numeral 72. The player or players are caused to take shots at virtually every angle and distance from the basket and thus their shooting skills are accurately assessed relatively to position. The players are constantly scored according to the successful shots and the degree of difficulty assigned to such shots. The game score is thus a true measure of the shooting skills of the player or players.

In order to make room for all competitors irrespective of their individual skills, it is possible to assign handicaps to individual players so that all may participate regardless of their skill.

The game is especially valuable in encouraging participation regardless of the level of skill and it is also valuable in evaluating a given player by a coaching staff.

The present invention contemplates team play as well as individual play in that the combined scores of players is utilized as a team score. Thus, team can compete against team with each team receiving the cumulative scores of its respective players.

The markers as previously mentioned can be numbered and colored according to design preference and the markers, while variable in composition, are typically rubber, nitrile and neoprene.

In another aspect of the game, the game contemplates moving a player from a more difficult shot position to a less difficult shot position after each miss so that play is always in accordance with the level of skill of the player in order to avoid frustration and loss of interest in the game.

OPERATION

In operation, the scoring elements 18–36 are laid out at a preferred angle on the court and the players each having at least one foot on a given marking element take their shots in turn. If the shot is successful, a score is reported on the scoring sheet 66 according to the number on the marking element which the player touches with his foot when the shot was made. Play continues with the players competing against themselves or each other, as individuals or teams.

More than one scoring element or a combination of scoring elements can be used, and their position changed from time to time so that the player gains familiarity with shooting from all parts of the floor. The player learns to appreciate the difficult shots as well as the easy shots since scoring is not only on the basis of baskets but from where the basket is made. Thus, a truer measure is made in this game because I combine the successful shots and difficulty of making such shots.

A player who is behind can select where he makes his shot so that proficiency is developed, taking into account the difficult as well as the easy shot and a premium is placed on consistency as well as shooting success.

The game is found to open competition to all players because it takes into account the original as well as the improving skills of the players.

The game is also a useful evaluating means for coaches and physical education instructors to evaluate the level of performance of the players.

ADDITIONAL GAMES

Another game which can be played with the present marking system is "ten ball." In this game, contestants shoot successively and each contestant starting from No. 1 continues shooting from one marking element to the next until the contestant misses. The next contestant then takes the following turn until the second contestant misses. On the second round, the first contestant resumes shooting from the spot that his last miss occurred and the first player to complete making baskets from all of the scoring elements is declared the winner.

CONCLUSION

It should be clear from the foregoing description that the games playable with the present invention can occur both indoors and outdoors and variations of the games described can be improvised, modified or added to, all within the teaching of the present invention. By specific reference to certain games this should not be construed as a limitation of the invention but merely to suggest its scope and versatility.

Another important feature of the present invention is that the marking elements are connected by relatively soft, plastic straps and there is no use of staples, screws or other metallic elements which could mar or otherwise damage hardwood playing surfaces and for that reason the invention is useable on expensive playing surfaces which are prone to be damaged, for driveways, and for other playing surfaces in general without limitation.

Although the present invention has been illustrated and described in connection with a few selected example embodiments, it will be understood that these are illustrative of the invention and are by no means restrictive thereof. It is reasonably to be expected that those skilled in this art can make numerous revisions and adaptations of the invention and it is intended that such revisions and adaptations will be included within the scope of the following claims as equivalents of the invention.

What I claim is:

1. A basketball game intended for use with a basketball playing floor and backboard on which a basket is mounted, comprising a plurality of numerically identified marking elements of different sizes and shapes, and each bearing a different numerical value thereon, said marking elements each having a slot one at each of opposite ends thereof, and a plurality of flexible elongated rectangular strips each having a smooth nonabrading outer surface and each including notched ends proportioned to be received one within a respective slot of adjacent marking elements to locate successive adjacent elements relative to each other, said elements being individually moveable and moveable together about the playing area in relation to the basket to designate locations from which a player makes a shot and providing a scoring value when the shot is successful according to the marking element at the spot at which the basket is made.

* * * * *